US005964139A

United States Patent [19]

Spatz et al.

[11] Patent Number: 5,964,139

[45] Date of Patent: Oct. 12, 1999

[54] APPARATAS FOR PRODUCING CONTAINER CAP

[75] Inventors: Günter Spatz, Biblis; Wolfhard Schwarz, Worms, both of Germany

[73] Assignee: Alcoa Deutschland GmbH, Worms/Rhein, Germany

[21] Appl. No.: 08/929,062

[22] Filed: Sep. 15, 1997

Related U.S. Application Data

[62] Continuation of application No. 08/653,365, May 24, 1996, abandoned, which is a division of application No. 08/622,054, Mar. 26, 1996, abandoned, which is a continuation of application No. 08/170,223, filed as application No. PCT/EP92/01474, Jun. 25, 1992, abandoned.

[30] Foreign Application Priority Data

Jun. 29, 1991 [DE] Germany ..... 41 21 619
Jun. 29, 1991 [DE] Germany ..... 41 21 618

[51] Int. Cl.[6] ..... B26D 3/08

[52] U.S. Cl. ..... 83/879; 083/946; 425/291; 425/809

[58] Field of Search ..... 83/39, 54, 946, 83/879; 30/1.5; 215/252, 257; 413/8, 10, 11, 67; 264/154, 268; 425/291, 809

[56] References Cited

U.S. PATENT DOCUMENTS

| | | | |
|---|---|---|---|
| 842,055 | 4/1907 | Spatz et al. . | |
| 2,896,317 | 7/1959 | Vaive | 30/1.5 |
| 3,379,155 | 4/1968 | Wheaton et al. | 413/17 |
| 4,151,643 | 5/1979 | Pomante | 30/1.5 |
| 4,217,989 | 8/1980 | George | 215/253 |
| 4,443,925 | 4/1984 | Fish | 83/54 |
| 4,497,765 | 2/1985 | Wilde et al. | 264/268 |
| 4,540,098 | 9/1985 | Luker | 215/253 X |
| 4,567,655 | 2/1986 | Jacobs | 30/1.5 |
| 4,595,547 | 6/1986 | Herr | 264/154 |
| 4,640,673 | 2/1987 | Takeda et al. | 425/297 |
| 4,666,053 | 5/1987 | Corcoran et al. | 215/252 |
| 4,720,018 | 1/1988 | Schetzsle et al. | 215/252 |
| 4,904,435 | 2/1990 | Babcock et al. | 264/154 |
| 5,370,520 | 12/1994 | Ingram | 425/324.1 |
| 5,451,360 | 9/1995 | Ingram | 264/268 |
| 5,488,888 | 2/1996 | Kowal | 264/154 |
| 5,554,327 | 9/1996 | Imgram et al. | 264/40.5 |
| 5,557,999 | 9/1996 | Smith et al. | 83/54 |

FOREIGN PATENT DOCUMENTS

| | | |
|---|---|---|
| 25064/67 | 7/1967 | Australia . |
| B-75099/91 | 4/1991 | Australia . |
| WO 92/22464 | 12/1993 | Australia . |
| 38555 | 7/1992 | Chile . |
| A-007334 | 3/1983 | European Pat. Off. . |
| 0592506B1 | 4/1994 | European Pat. Off. . |
| 2222655 | 11/1972 | Germany . |
| U-8709690 | 1/1988 | Germany . |
| 3723235 | 1/1989 | Germany . |
| 3727887 | 3/1989 | Germany . |

*Primary Examiner*—Kenneth E. Peterson
*Attorney, Agent, or Firm*—Staas & Halsey

[57] ABSTRACT

An apparatus for producing a container cap. The cap is formed of plastic and includes a flat top, a casing emanating from the flat top, and a guarantee area provided in an edge zone of the casing. The guarantee area includes at least one holding section on a surface thereof and at least one vertical incision extending over a height of the guarantee area. The apparatus includes a centering device which rotates and securely holds the cap in a fixed position based on the at least one holding section, and a cutting device which cuts the at least one vertical incision into a wall of the guarantee area at a predetermined distance from the at least one holding section while the centering device rotates and securely holds the cap in the fixed position.

15 Claims, 3 Drawing Sheets

APPARATAS FOR PRODUCING CONTAINER CAP

This application is a continuation of application Ser. No. 08/653,365, filed May 24, 1996, now abandoned, which was a divisional of application Ser. No. 08/622,054, filed Mar. 26, 1996, now abandoned, which is a continuation of application Ser. No. 08/170,223, filed Dec. 29, 1993, now abandoned, which is a 371 of PCT/EP92/01474, filed Jun. 25, 1992.

BACKGROUND OF THE INVENTION

1. Field of the Invention

This invention relates to a plastic cap for containers and and more particularly to a plastic cap with a guarantee ring.

2. Description of the Prior Art

Numerous plastic caps are known DE G 87 09 690.0; U.S. Pat. No. 4,666,053) which are used to close any type of container. The caps have a guarantee ring which serves to indicate that the closed container has not been previously opened. During a first attempt at opening the container, the guarantee ring will snap open, so that a consumer can readily note that the container is no longer closed in the original way.

In the case of the caps produced in a forming process (DE G 87 09 690.0 U1), it was found that the zones of a smaller wall thickness which tear during the bursting-open of the guarantee ring and which are also called vertical incisions, in the end do not have any defined wall thickness so that the tearing-open behavior of the cap cannot be reliably predetermined. In the case of caps which have tear zones defined by a cutting operation (U.S. Pat. No. 4,666,053), it is in many cases not possible to introduce the bursting forces occurring during the first opening into defined areas of the guarantee ring in order to ensure a reliable tearing. In both cases, it is therefore possible that a first opening of the container may not be indicated to the consumer.

Finally, metal caps are known (see U.S. Pat. No. 4,217,989) which are subjected to a forming as well as a cutting process during a single manufacturing operation. However, processes of this type cannot be applied to plastic caps of the type addressed here because the plastic forming process cannot be combined with a cutting operation.

During the production of the caps and the associated containers, naturally size deviations occur. It may happen that a cap with a maximum inside diameter that lies within the tolerance range is combined with a container, the outside diameter of which does, it is true, lie within the tolerance range, but has the smallest outside diameter that is still possible. In such a case it is possible that during the first opening of the container, the forces exerted on the guarantee ring or guarantee area are not sufficient to make it snap open, so that it slides undamaged over the outside wall or the mouth part of the container when the cap is opened for the first time. This is, in particular, due to the fact that the so-called vertical incisions, by which the guarantee area is split into at least two segments, have too great a production-related strength.

SUMMARY OF THE INVENTION

It is, therefore, the object of the invention to create a plastic cap, as well as a process and an apparatus for the production thereof, with which the above stated disadvantages do not occur.

This object is achieved with the aid of a plastic cap which has the features indicated in claim 1. Because the vertical incisions in the wall of the guarantee area are cut in dependence on specific form characteristics of the cap, it can on the one hand be ensured that the material thickness in the vertical incision complies exactly with the desired prerequisites, and that on the other hand the weakening line in the guarantee area created by the vertical incision is arranged in such a way that the snapping-open forces that occur during the first opening of the cap occur exactly in this area. In this manner a defective functioning of the cap can practically be excluded. During any attempt at opening an originally closed container, the guarantee area will snap open, so that the consumer can recognize such actions.

Particularly preferred is an exemplified embodiment of a cap, which is characterized in that the position of the vertical incisions is chosen in dependence on the arrangement of the holding webs which hold the ring segments that occur during the snapping open onto the casing of the cap. By choosing the distance between the vertical incisions in dependence on the holding webs, which do not tear off during the snapping open of the guarantee ring, the vertical incisions are placed in an area of the guarantee ring which during the first opening experiences a maximum deflection, in the axial as well as in the radial direction. This guarantees a snapping open of the vertical incisions.

Particularly preferred is an embodiment of the cap, with which the vertical incisions are bridged by webs. This avoids that after manufacture of the cap, during its storage or transport, but also during the first putting on, the vertical incisions can be damaged, so that a consumer could possibly draw false conclusions about the container having been interfered with. This increases the certainty of the indication of manipulations even further.

Further embodiments of the cap can be noted from the other sub-claims.

The mentioned object is also achieved by a process for the production of a plastic cap for containers which has the features indicated in claim 13. This process is characterized in that, after making a horizontal incision which constitutes the predetermined breaking line between the casing and guarantee area of the cap, the vertical incisions are made in dependence on specific form characteristics of the cap or guarantee area. In principle, any weakening of the material in the wall of the guarantee area can be regarded as vertical incisions, also if the wall of the guarantee area has only notches or material weakening zones which were produced by injection moulding, but not by a cutting process. With the process that is relevant here, the vertical incisions are, in fact, produced in the wall of finished caps by a cutting operation, so that one obtains a specific weakening of the material which can be predetermined far more accurately than with an injection moulding process. This means, therefore, that the holding forces in the area of the vertical incision can be predicted very accurately. Furthermore, as a result of the exact positioning of the vertical incisions, the snapping open forces that occur can be accurately predetermined. In this way any manipulations of the container without damaging the guarantee ring can be securely avoided.

Particularly preferred is an embodiment of the process with which the vertical incisions are made in dependence on the arrangement of the holding webs in the wall of the guarantee area or the guarantee ring. The holding webs remain intact when the container is opened for the first time. The end sections of the ring segments held by the holding webs are deflected to their maximum extent in the axial as well as the radial direction, so that here the greatest snapping open forces occur. Due to the fact that the vertical incisions are arranged precisely here, they will with the greatest probability snap open.

Additional further developments of the process can be noted from the other sub-claims.

Finally, the mentioned object is also achieved by the creation of an apparatus which serves to produce a plastic cap with guarantee ring for containers and has the features indicated in claim 1. The apparatus is characterized by a centring device which positions, takes hold of and keeps the cap in position in dependence on its form characteristics whilst the cap is brought into contact with the cutting device.

Particularly preferred is an apparatus, the centring device of which comprises an outside centring device as well as an inside centring device, wherein the former scans form characteristics on the outside and the latter form characteristics on the inside of the cap. In this way a universal scanning of the form characteristics of the cap is possible, wherein these may be arranged either on the outside or on the inside surface of the cap, or also on both sides.

Particularly preferred is an apparatus which is characterized in that the inside centring device is constructed in such a way that the inside contours of the cap can be scanned only after the outside contours have been scanned. As a result of the double scanning of the form characteristics on the outside, and then on the inside of the cap, a particularly secure positioning of the cap is obtained before the vertical incisions are made in the wall of the guarantee ring.

Further embodiments of the apparatus can be noted from the other sub-claims.

BRIEF DESCRIPTION OF THE DRAWINGS

In the following the invention will be explained in greater detail with reference to the figures, wherein.

DETAILED DESCRIPTION OF THE PREFERRED EMBODIMENTS

The cap described in the following can be used universally. It is used preferably to close bottles which are provided on the outside, underneath their mouth area, with a screw thread and furthermore have a projecting part which co-operates with barbs provided on the inside surface of the guarantee ring.

Figure 1:
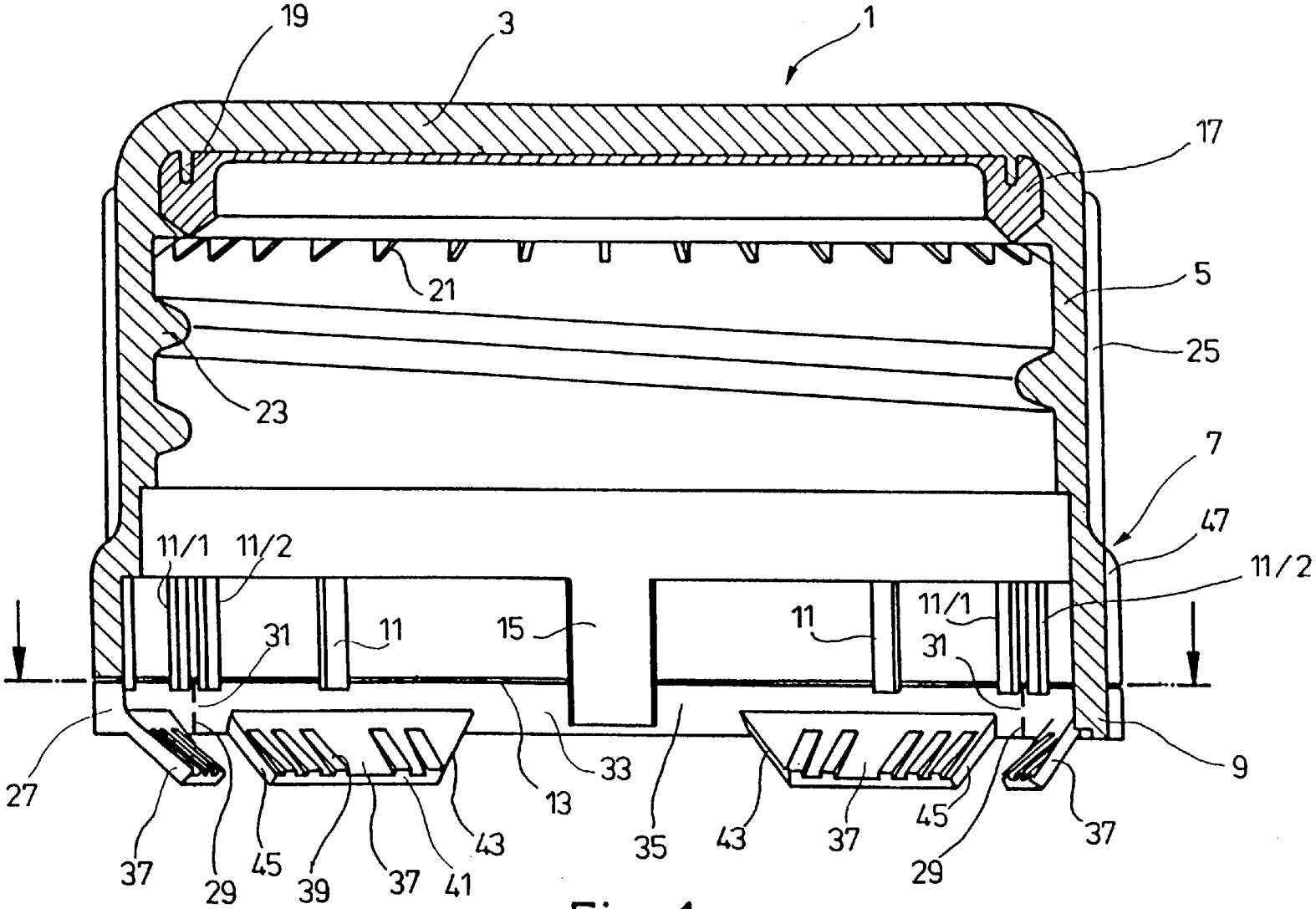
FIG. 1 shows a longitudinal section through a cap.

FIG. 1 shows a cross-section through a cap 1 before it is put onto a to be closed container. The cap has a flat top 3 and a round closed casing 5. In the bottom edge part 7 of the casing 5 a guarantee area is provided, in this case in the form of a guarantee ring 9, which is joined to the rest of the casing by tear-off webs 11, the tear-off webs bridging a predetermined breaking line 13 which is provided by making a horizontal incision in the wall of the casing 5.

The predetermined breaking line 13 is furthermore bridged by a holding web (or "section") 15 which extends practically over the entire height of the guarantee ring 9. The tear-off webs 11 and the holding web 15 are formed by material strips which are provided on the inside surface of the casing and extend in the longitudinal direction of the cap. From FIG. 1 it can be noted that the tear-off webs are considerably narrower than the holding web, which is in each instance associated with a ring segment produced by the snapping open of the guarantee ring 9.

On the underside of the flat top a seal 17 is provided, which is prevented from moving relative to the flat top 3 or the cap 1 by holding cams 19 projecting into same. In addition several webs 21 are provided that emanate from the inside surface of the casing and hold the seal 17 in its correct position. After the cap 1 is put onto a to be closed container, the seal engages with the mouth area thereof and seals same.

On the inside surface of the casing 5, screw threads 23 can be noted. which mesh with a corresponding external thread on the outside of the container.

On the outer surface of the casing, ribs 25 are provided extending in the axial direction, which improve the grip of the cap.

The wall 27 of the guarantee ring 9 has vertical incisions 29 which do not extend over the entire height of the guarantee ring. There remains in each instance at least one bridging web 31, which forms a connection between the end sections of the ring segments 33 separated by the vertical incisions 29.

The bridging webs 31 can be formed in that during the making of the vertical incisions 29, a knife provided with a groove is used, which leaves part of the wall 27 of the guarantee ring 9 intact. It is also possible to provide on the inside surface of the guarantee ring 9, in the area of the vertical incisions, a web which is offset to the inside and which, similar to the tear-off webs and the holding web 15, remains intact when a cut with a specific depth is made.

From the inside surface 35 of the guarantee ring 9 emanates in this case slantingly downward extending projections 37, which at the top are provided with reinforcing ribs 39 which—proceeding from the front 41 of the projections 37 taper down in the form of a ramp in the direction of the inside surface 35 of the guarantee ring 9, and at a distance from this inside surface go over into the surface of the projections 37. The front face of the reinforcing ribs 39 together with the front face of the projections 37 forms a common stop surface.

The projections 37 are shaped such that they emanate from the inside surface 35 of the guarantee ring at a distance from a holding web 15, and on their side facing the holding web have slanting sides 43. The sides 45 on the opposite side of the projections form a right angle with the inside surface 35 of the guarantee ring 9. The distance of these sides 45 to a directly adjacent vertical incision 29 is considerably less than that to the adjacent holding web 15.

From FIG. 1 it can be seen that in the direct vicinity of the vertical incision 29 tear-off webs 11/1 and 11/2 are provided, which prevent an unintentional tearing off of the end sections of the ring segments 33.

On the outside of the edge 7 of the casing 5 recesses 49 are provided, a side edge of which can be seen in FIG. 1.

Figure 2:
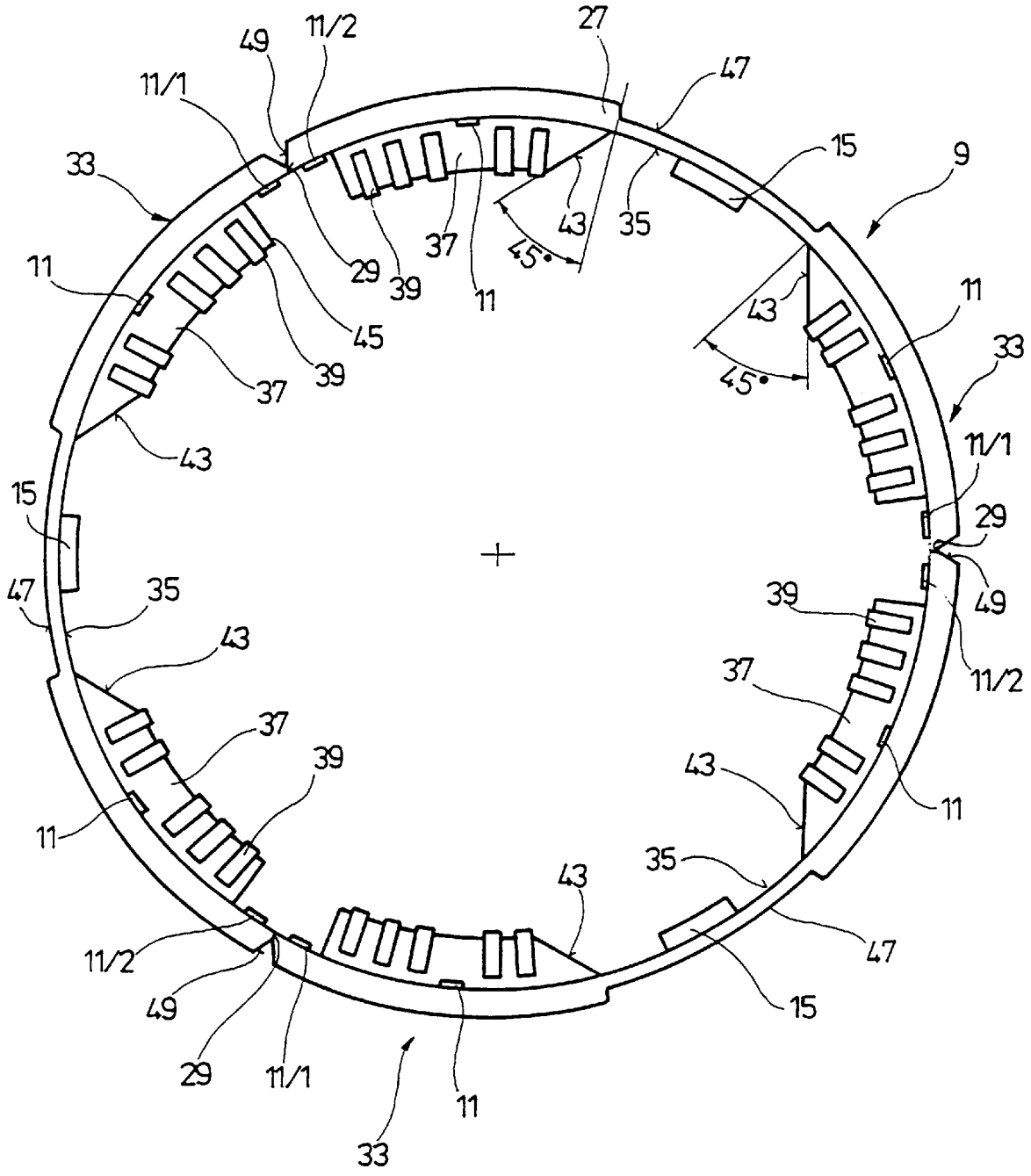
FIG. 2 is a top view onto a guarantee ring cut off along the line II—II shown in FIG. 1.

FIG. 2 shows a top view onto a guarantee ring 9 cut off along the line II—II shown in FIG. 1.

Where parts in FIGS. 1 and 2 are the same, they have been given the same reference numerals, so that a detailed description thereof can be dispensed with.

From the top view according to FIG. 2 one can note the cut-off tear-off webs 11 as well as 11/1 and 11/2, and also the cut through the holding webs 15.

The top view shows that with the exemplified embodiment illustrated here, a guarantee ring 9 consists of three ring segments 33, each of which is held by a holding web 15.

In the end sections of the ring segments V-shaped material recesses 49 can be seen, in the base of which the vertical incisions 29 are made. A material weakening demanded of the production process is weakened in an accurately predetermined manner by the specific incision 29.

From the top view the grooves 47 provided in the outside surface of the guarantee ring 9 can be seen, which are arranged precisely there where on the inside surface 35 of the guarantee ring 9 the holding webs 15 are arranged. The width of the grooves 47 is greater than the width of the holding webs, which are arranged centrally in relation to the groove.

From the top view according to FIG. 2 it can clearly be seen that the tear-off webs 11 and the holding webs 15 consist of material sections that are offset radially to the inside, so that during a specific horizontal cut through the walls 27 of the guarantee ring they remain practically intact.

In particular from the top view of FIG. 2 it can be deduced that the cap 1 or its guarantee ring 9 has several form elements which are arranged on the outside or the inside surface of the guarantee ring 9. By using these form elements, one can ensure an accurate alignment of the cap when making the vertical incisions 29. As form elements, one can use the projections 37 or their sides 45 and 43. Also the position of the holding webs 15 on the inside surface 35 of the guarantee ring 9 can be used for the accurate alignment of the cap. Finally, the grooves 47 or V-shaped recesses 49 provided on the outside surface of the guarantee ring 9 can be used for the exact positioning of the cap when making the vertical incisions 29. From all this it can be seen that also on the outside surface of the casing 5 of the cap 1 projections or recesses can be provided for its positioning.

In the following it is assumed that the grooves 47 provided on the outside surface and the holding webs 15 which in these areas are provided on the inside surface 35 of the cap 1, are used for the accurate alignment of the cap 1.

The apparatus for the production of the plastic cap illustrated in FIGS. 1 and 2 will be explained with reference to the sectional view of FIG. 3.

The tool 50 has a housing 51 that can be coupled to a drive which produces a rotational and translatory movement of the housing 51. With this, the tool 50 can rotate around the axis of rotation or the longitudinal axis 53. A translatory movement takes place along this axis.

The housing 51 is preferably cylindrical, in particular circular cylindrical. It has a through-bore which serves to accommodate an inside centring device 55.

On the right face of the housing 51 a holder 57 for an outside centring device 59 is provided in a suitable recess.

The inside centring device 55 has a guide sleeve 61 which is placed in the through-bore 51. The guide sleeve 61 can be moved in the axial direction inside the housing 51 against the force of a spring element 63 in the form of a helical spring. The helical spring is supported on suitable projections as well as on the guide sleeve 61 and also in the through-bore of the housing 51. By means of a groove 65 provided in the inside wall of the housing 51 and a spring 67 emanating from the guide sleeve 61, a turning of the two elements relative to one another is prevented.

Inside the guide sleeve 61 a fixing device 95 is provided, which comprises a pressure stamp 97 which penetrates the inside centring device 55 and a thrust block 69 which is anchored inside the guide sleeve 61, e.g. by screwing. Supported inside the thrust block 69 is a helical spring 71, which by means of a resilient force pushes the pressure stamp 97 out of the face of the inside centring device 55.

The pressure stamp is held by a suitable bearing arrangement 73 in such a way that during a rotating movement of the tool 50 it is held already by a small counter-force and will not turn along. The end of the pressure stamp positioned inside the tool 50 is held by a bearing arrangement 75 that co-operates with the helical spring 71, and which in turn is fitted with a bearing 77 to ensure an end coupling of the rotating movement of the tool 50.

The bearing arrangement 73 has an outside sleeve which by the co-operation between groove and spring is held in the guide sleeve 61 in such a way that it will not rotate.

Figure 3:
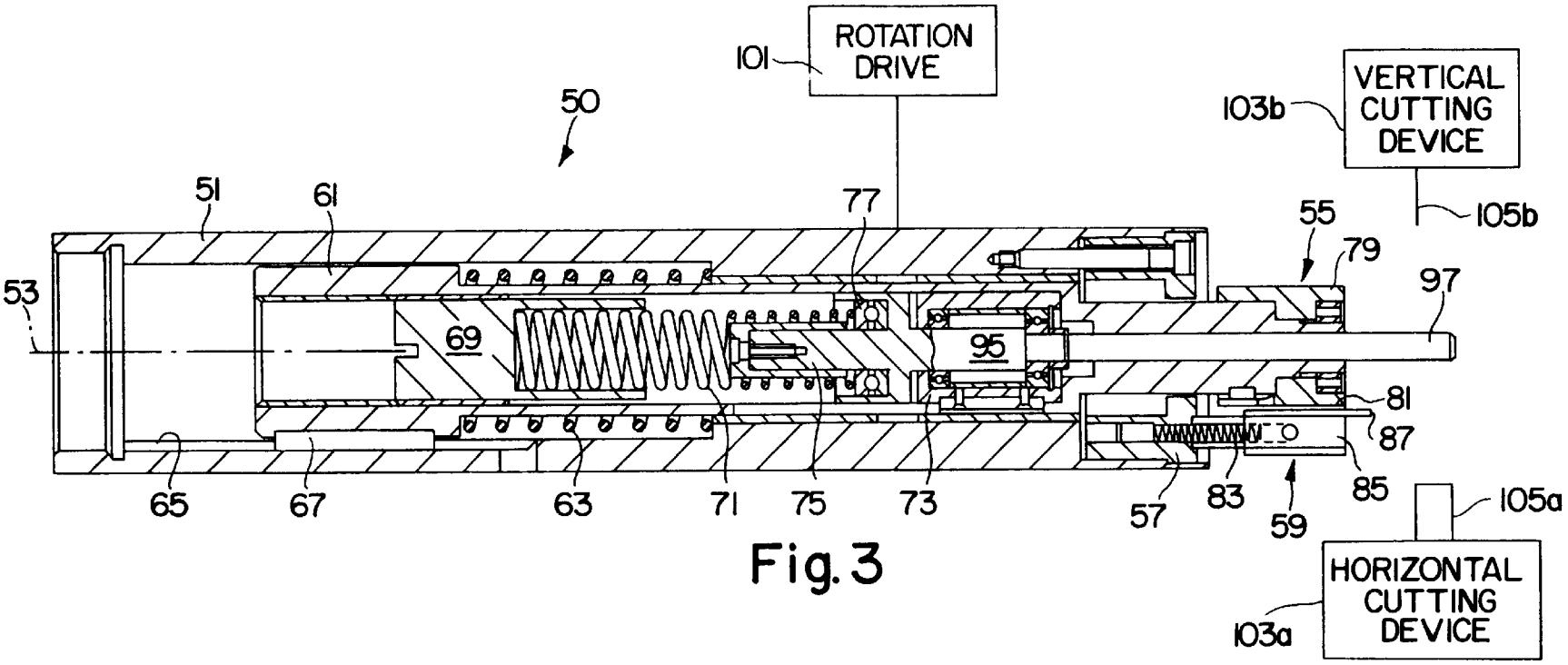
FIG. 3 is a longitudinal section through an apparatus for the production of a cap according to FIG. 1.

On the front of the inside centring device 55 which in FIG. 3 is positioned on the right, a form element 79 is provided, the outside contour of which is adapted to the inside contour of a cap that must be held, which is not shown here. With the exemplified embodiment illustrated here, the outside contour of the form element 79 is made such that, for example, the holding webs 15 of the cap illustrated in FIGS. 1 and 2 are held by a corresponding groove 81 provided in the outside surface of the form element 79.

The form element 79 is exchangeable, so that with the tool 50 several different shapes of caps can be held.

The outside centring device 59 comprises a scanning element 85 which is elastically moveable in the direction of the centre axis 53 against the force of a spring element 83. The scanning element 85 comprises a tracing pin 87, which scans the outside surface of the cap and is designed in such a way that it fits into the groove 47 provided in this outside surface.

In the following further details will be provided of how the process is performed and of the mode of operation of the apparatus:

A cap, as illustrated in FIGS. 1 and 2, is fed to the tool 50 with the flat top 3 facing away from the face of the tool, so that when the tool 50 approaches, the pressure stamp 97 will engage in the inside of the cap 1 and comes to rest against the inside surface of the flat top 3.

To scan the outside contours of the cap 1, either the cap is made to rotate by a rotation device 101 in relation to the tool or, as shown here, the tool 50 is made to rotate by rotation drive 101 in relation to the cap 1.

In the neutral position of the tool, illustrated in FIG. 3, the pressure stamp 97 projects beyond the face of the inside centring device 55, and the tracing pin 87 of the outside centring device 59 projects beyond the face thereof.

When the tool approaches the cap, the latter is fixed in its holder by the compressive force exerted by the pressure stamp, and is held there in such a way that it cannot rotate. Because of the rotating of the tool 50, the tracing pin 87 of the outside centring device 59 now engages with the outside contour of the cap 1 and mechanically scans it, until the tracing pin 87 locks into the groove 47 provided in the outside surface. The holder of the cap is designed in such a way that the cap now turns along synchronously with the tool 50 inside its holder.

By means of a suitable actuating device—not illustrated here—the guide sleeve 61 is now displaced to the right in the direction of the axis of rotation of the tool 53 against the force of the helical spring 63, so that the inside centring device 55 or its form element 79 moves into the inside of the cap. Due to the stationary arrangement between the outside centring device 59 and the inside centring device 55, the inside centring device can engage in the inside contour of the cap without any further re-adjustment.

It is, therefore, ensured that when the tracing pin 87 engages in the groove 47 of the cap, the groove 81 of the form element 79 coincides with the holding web 15 of a cap.

Naturally, with the present exemplified embodiment three the same grooves 81 are provided on the outside surface of the form element 79, so that when the inside centring device 55 is introduced into the inside of the cap 1, the grooves 81 will take hold of the holding webs 15.

The inside centring device is now pushed forward so far until the face of the form element 79 sinks onto the base of the cap, and the latter is securely held in position. During this movement of the inside centring device into the inside of the cap, the projections 37 are folded inwards, so that they are swivelled slantingly upwards in the direction of the inside of the flat top 3. As a result thereof the cap 1 is securely held in position on the form element 79 of the inside centring device 55. After the inside centring device has snapped in, the outside centring device moves up to free the outside or casing surface of the cap for the cutting operation.

Now, with the aid of a horizontal cutting device, 103*a* the predetermined breaking line 13 can be provided in the edge part 7 of the casing 5 by means of a horizontal cut, the depth of the cut being adapted to the thickness of the wall 27 in such a way that the knife (or blade) 105 does not or not significantly damage the inwardly offset tear-off webs 11 and the holding webs 15. The horizontal cutting device 103*a* preferably comprises a known cutting device having a horizontal blade (in relation to the path of the cap) against which the cap is rotated to produce the horizontal cut.

The outside surface of the form element 79 is designed in such a way that at the same time it serves as an abutment for the cutting device, during the making of the horizontal as well as the vertical incisions.

After making the horizontal incision, because of its orientation on the inside centring device 55, the cap 1 can be fed to a vertical cutting device 103*b* in a predetermined position, so that the vertical cutting device 103 can now make the vertical incisions 29 in the wall 27 of the guarantee ring 9. The drive of the tool 50 is designed such that it can be moved towards the knife of the cutting device in an exact orientation. The vertical cutting device 103*b* preferably comprises a known cutting device having at least one vertical blade (in relation to the path of the cap) against which the cap is rotated to produce vertical incisions (one for each blade).

From all this it can be seen that because of the interplay between the outside centring device 59 and the inside centring device 55 an accurate position orientation of the cap 1 can be obtained, so that the incisions required to split the guarantee ring 9 into ring segments can be made with great precision.

Because a relative rotation between the outside centring device 59 connected rigidly to the sleeve 51 and the guide sleeve 61 of the inside centring device 55 is not possible, the inside centring device or its form element 79, after scanning the outside contour with the aid of the tracing pin 87, can without problem be introduced into the inside of the cap, during which the orientation of the cap is maintained.

The neutral position of the tool 50 illustrated in FIG. 3, in which the pressure stamp 67 of the fixing device 65 projects beyond the face of the form element 79 together with the tracing pin 87, ensures that at first the cap 1 is securely held in position in its holder by the pressure stamp, whilst the tracing pin 87 which rotates together with the tool 50 scans the outside contours of the cap 1. As soon as the tracing pin 87 locks into the associated groove 47, the driving force of the tool 50 becomes so great that the cap is made to rotate inside its holder together with the tool. In this way the inside centring device can be securely introduced into the co-rotating cap. In the end position, in which the inside centring device 55 is moved out completely by the forward movement of the guide sleeve 61, the inside centring device projects beyond the face of the pressure stamp as well as beyond the tracing pin of the outside centring device 59, so that a displacement of the cap by the tool itself need now no longer be feared. Furthermore, this forward movement of the inside centring device 55 ensures that during the making of the horizontal incision to produce the predetermined breaking line 13 or during the making of the vertical incisions 29 that extend in the longitudinal direction, the cutting device will not come in contact with the outside centring device. This prevents damages to the cutting device as well as to the tool 50.

If during the making of the vertical incisions 29 one does not use a knife with a groove, by which the areas or webs 31 that bridge the vertical incisions remain intact, it is also possible to use a knife with a continuous cutting edge if on the inside surface 35 of the guarantee ring 9, the same as with the tear-off webs 11 and the holding webs 15, radially inwardly offset material sections are provided which remain intact or at least remain substantially uncut when making the cut with a specific depth.

To increase the effectiveness of the apparatus or the production process, the tool 50 may be placed in a machining star, to which the to be machined caps are fed in the known manner.

From all this it can readily be seen that the production process and the apparatus can be used irrespective of which outside or inside contours are used for the scanning when making the vertical incisions in the cap. All that is required is that the relative arrangement of the scanned contours or form characteristics to the position of the to be provided vertical incisions is known, so that the bringing together of the tool 50 and the cutting device, which is not shown here, can be arranged in such a way that the vertical incisions can be made in the desired, predetermined position. They may, for example, be positioned in the end sections of two adjacent ring segments 33, so that these end sections are held by the tear-off webs 11/1 and 11/2, in which case the cut of the vertical incisions 29 is preferably made in the base of the V-shaped recess 49. In this way relatively little material needs to be cut, so that the life of the knives is increased considerably.

With the construction of the tool 50 described here or the performing of the production process in the manner described here, it is ensured that the vertical incisions 29 are arranged in the immediate vicinity between the sides 45 of the projections 37 that taper down perpendicularly to the inside surface 35, where during a first opening of the cap the maximum force is introduced into the guarantee ring. Therefore, also if the vertical incisions have a certain strength as a result of the bridging webs 31, it is ensured that during the first attempt at opening the cap 1, the guarantee ring 9 of the cap 1 will snap open. When this happens, the projections 37 that act as barbs will dig in under the mentioned projection on the outside of the container and will produce axial and radial expansion forces on the guarantee ring, so that same will snap open. With the exemplified embodiment illustrated in the figures, the holding webs lie in the rotation and swivel point of the ring segments 33 and remain intact during the snapping open of the guarantee ring. They are made so strong that they hold the snapped open ring segments in the swivelled position, so that the consumer can readily see that the cap has been interfered with.

Finally, it must still be mentioned that in individual fields of application, where the positioning of the vertical incisions is less critical, the outside centring can be dispensed with. In this case the inside centring device 55 is moved against the cap fixed in position by a holder until the form element 79 locks into the given inside contours of the cap and securely holds same.

From what has been mentioned above, it can readily be noted that in a plastic cap, which may be made, for example, by an injection moulding or compression moulding process, subsequently a vertical incision can be provided in an exactly predetermined spot. The positioning of the vertical incision depends here on the form characteristics provided on the inside and/or outside of the cap, which can be scanned with the aid of a suitable device.

When making the vertical incision it is quite possible to just provide a guarantee area that does not extend over the entire periphery at the bottom edge of the casing, but is associated, for example, with an arc-shaped circumferential area which has an opening angle of 60 to 240°, preferably of 180° or 120°. The vertical incision is preferably placed in the middle of such a guarantee area, i.e. in an area which during the first opening of the cap is subjected to a maximum axial and radial displacement. In this way it is ensured that the vertical incision will snap open during the first opening, so that the consumer can readily note that the cap has been interfered with. The end sections of such a guarantee area are fixed to the rest of the casing. In this case no holding webs are required which hold the segments after the snapping open of the vertical incision. Here, the segments are joined by way of their end sections to the rest of the cap and cannot get lost.

An important aspect is that the vertical incisions can be made at a later stage in pre-manufactured plastic caps, and in doing so an accurately predetermined positioning is maintained, so that deformations that occur during the first opening of the cap are introduced exactly into the vertical incision.

Naturally, it is also possible to make caps that have two guarantee areas which snap open into segments during the first opening, which segments are in turn held by holding webs. Finally, as illustrated by the figures, it is also possible to make a cap with several guarantee ring segments distributed over the periphery of the bottom edge, and which segments form an all-round guarantee ring.

Finally, the making of the vertical incisions can take place independently of the special shape of the form characteristics used for the positioning. The exact arrangement of the vertical incisions can at any rate be maintained, wherein the form characteristics may be arranged on the inside and/or on the outside of the cap.

Because of the described, exact positioning of the vertical incisions, when producing same, the making of a horizontal incision—extending over a circumferential area or along the entire periphery—by which the guarantee area or a guarantee ring is formed, can take place in an independent, autonomous process step. It is possible, in particular, to use completely separate cutting devices for making the two incisions (horizontal incision and vertical incision), so that the requirements on the cutting device can be relatively low and same can be produced economically.

It has been found that especially with the particularly stable design of the projections 37, with the aid of reinforcing ribs 39 provided at the top thereof, very high snapping open forces can be introduced into the vertical incisions. By the combination of an exact positioning of the vertical incisions and the introduction of particularly high snapping open forces into the areas provided with vertical incisions, an extremely high operational reliability is obtained, based on which any interference with the cap will with a particularly great certainty lead to a snapping open of the vertical incisions, so that the consumer can securely recognize an originally closed container.

We claim:

1. An apparatus for producing a container cap, said cap being formed of plastic and including a flat top, a casing emanating from said flat top, and a guarantee area provided in an edge zone of the casing, said guarantee area including at least one holding section on a surface thereof and at least one vertical incision extending over a height of the guarantee area, said apparatus comprising:

a centering device which rotates and securely holds the cap in a fixed position based on a form characteristic provided on the casing in a fixed relationship to said at least one holding section, said centering device comprising an outside centering device having a tracing pin biased against, and rotatable around, the casing; and a vertical cutting device having a blade, the cutting device placed relative to said apparatus, said centering device moving relative thereto so as to bring the cap into engagement with the vertical cutting device so as to produce said at least one vertical incision into a wall of the guarantee area at a predetermined distance from the at least one holding section while said centering device rotates and securely holds the cap in said fixed position.

2. The apparatus according to claim 1, wherein:

the tracing pin of said outside centering device engages with the form characteristic provided on an outside surface of the cap; and said centering device further comprises an inside centering device having an inside scanning device which locates the at least one holding section provided on an inside surface of the cap.

3. The apparatus according to claim 2, wherein at least the inside centering device rotates in relation to the cap, when the cap is positioned to be held by the centering device, about an axis of rotation coinciding with a center axis of the cap, and the outside centering device is resiliently spring mounted and engages with the form characteristic on the outside surface of the cap.

4. The apparatus according to claim 2, wherein the inside scanning device is so dimensioned to be moveable into an inside cavity defined by the casing of the cap and to engage a second form characteristic on the inside surface of the cap, whereby the inside centering device locates the at least one holding section on the inside surface of the cap after the outside centering device engages on the form characteristic the outside surface of the cap.

5. The apparatus according to claim 4, wherein the outside centering device projects beyond the inside centering device in the direction of the cap, when the cap is in position to be held by the centering device and the inside and outside centering devices are movable in relation to one another in the direction of the axis of rotation.

6. The apparatus according to claim 2, further comprising a holding device which, during the location of the form characteristic and the at least one holding section, holds the cap such that said cap cannot rotate.

7. The apparatus according to claim 6, wherein the centering device comprises a fixing device which holds the cap in the holding device.

8. The apparatus according to claim 7, wherein the fixing device comprises a rotatably mounted pressure stamp which penetrates the centering device.

9. The apparatus according to claim 2, wherein the inside centering device moves in relation to the outside centering device.

10. The apparatus according to claim 2, further comprising a locking device which prevents a relative rotation between the outside centering device and the inside centering device.

11. The apparatus according to claim 1, further comprising a circular cylindrical housing which accommodates a plurality of individual sub-assemblies and which is connectable to a drive which produces movement along at least one of an axis of rotation and a center axis of the apparatus.

12. The apparatus according to claim 1, further comprising a horizontal cutting device which cuts a horizontal incision in the casing.

13. The apparatus according to claim 12, wherein the horizontal cutting device includes a knife which makes the horizontal incision as the cap is relatively moved across the knife.

14. The apparatus according to claim 1, wherein during engagement with the cap said vertical cutting device is positioned to produce the at least one vertical incision in the wall of the guarantee area while leaving intact a bridging web located on a surface of the guarantee area opposite the wall from the at least one vertical incision.

15. An apparatus for producing a container cap, said cap being formed of plastic and including a flat top, a casing emanating from said flat top, and a guarantee area provided in an edge zone of the casing, said guarantee area including at least one holding section on a surface thereof and at least one vertical incision extending over a height of the guarantee area, said apparatus comprising:

a centering device which rotates and securely holds the cap in a fixed position based on a form characteristic provided on the casing in a fixed relationship to said at least one holding section, said centering device comprising an outside centering device having a tracing pin biased against, and rotatable around, the casing; and a vertical cutting device having a blade, the vertical cutting device placed relative to said apparatus, the vertical cutting device moving relative to the centering device so as to bring the blade into engagement with the cap so as to produce said at least one vertical incision into a wall of the guarantee area at a predetermined distance from the at least one holding section while said centering device rotates and securely holds the cap in said fixed position.

* * * * *